US005129109A

United States Patent [19]

Runckel

[11] Patent Number: 5,129,109

[45] Date of Patent: Jul. 14, 1992

[54] SWIM GOGGLES WITH INFLATABLE AIR GASKET SEAL

[76] Inventor: John L. Runckel, 16661 Phantom Bluff Ct., Lake Oswego, Oreg. 97034

[21] Appl. No.: 740,103

[22] Filed: Aug. 5, 1991

[51] Int. Cl.[5] ..... A61F 9/02

[52] U.S. Cl. ..... 2/440; 2/426; 2/431

[58] Field of Search ..... 2/426, 427, 428, 429, 2/430, 431, 432, 433, 440, 442, 443, 445, 446

[56] References Cited

U.S. PATENT DOCUMENTS

| | | | |
|---|---|---|---|
| 1,105,127 | 7/1914 | Drager | 128/206.26 |
| 1,742,412 | 1/1930 | O'Flanagan | 2/440 |
| 2,182,104 | 12/1939 | Wilen et al. | 2/440 |
| 2,393,533 | 1/1946 | Heinz | 351/43 |
| 2,539,284 | 1/1951 | Thomas | 351/62 |
| 3,710,393 | 1/1973 | Douglas | 2/430 |
| 3,755,819 | 9/1973 | Douglas | 2/430 |
| 3,895,397 | 7/1975 | Douglas | 2/446 |
| 4,290,673 | 9/1981 | Yamamoto | 2/437 |
| 4,817,633 | 4/1989 | McStravick | 2/443 |
| 4,872,217 | 10/1989 | Kitayama | 2/433 |
| 4,936,298 | 6/1990 | Nishina et al. | 128/206.26 |
| 5,066,022 | 11/1991 | Harrington | 2/440 |

FOREIGN PATENT DOCUMENTS

| | | | |
|---|---|---|---|
| 662671 | 5/1963 | Canada | 2/440 |
| 1004403 | 1/1977 | Canada | 2/440 |
| 1118953 | 3/1982 | Canada | 2/426 |
| 2052245 | 1/1981 | United Kingdom | 2/440 |

*Primary Examiner*—Werner H. Schroeder
*Assistant Examiner*—Diana L. Biefeld
*Attorney, Agent, or Firm*—Kolisch, Hartwell, Dickinson, McCormack & Neuser

[57] ABSTRACT

A pair of goggles having two eye pieces. Each eye piece has an eye piece frame with a frame portion that extends continuously about a lens opening. An inflatable cushion member is provided each eye piece that extends throughout the frame portion in the eye piece. The cushion member is preformed to have convex and concave curvature on its back side.

9 Claims, 1 Drawing Sheet

SWIM GOGGLES WITH INFLATABLE AIR GASKET SEAL

BACKGROUND AND SUMMARY OF THE INVENTION

This invention relates to eye goggles, such as might be worn during swimming, skiing, and other sports.

Goggles, if such are to find wide acceptance, should be easily mounted in place on the face and removed, should be comfortable, and, preferably, should give the wearer a wide field of view. Goggles intended for swimming and aquatic sports should be light in weight, streamlined, and also provide a proper seal about the eyes and between the face and the goggles, to prevent water from entering the interior of the goggles and distorting the vision of the wearer. Goggles in the form of an eye mask extending continuously across both eyes and with a common seal generally are cumbersome, and tend to limit vision, particularly laterally. Further, with eye mask type goggles, if there is any leakage in the goggles, water enters a goggle interior which extends across both eyes.

A general object of this invention is to provide improved goggles, having an eye piece with a separate lens and supporting frame for each eye, and an inflatable cushion for each eye piece which provides a seal established between the eye piece and the face of the wearer.

A further general object is to provide, in goggles, air-inflated cushion means for establishing a seal between the wearer's face and a lens frame, and which further includes means carried by the goggles for establishing and maintaining air at the desired pressure within a cushion means.

Yet another object is to provide improved goggles which include a pair of eye pieces, one for each eye, and each eye piece including a continuous frame which extends in a course about a lens opening and rests against the socket structure or orbit which receives the eye in the human head, the goggles further including and an inflatable cushion comfortably establishing a soft but reliable seal between each eye piece frame and the wearer's face.

In a preferred embodiment of the invention, the frame, as well as the cushion which provides the seal, are each provided with inwardly and outwardly curving regions, extending in a direction from the nose to the temple, thus best to conform to the contour which is usually found about the socket of the human eye. The inflatable cushion member which is associated with each eye piece frame, while being preshaped to approximately conform to the contours of the face, on being inflated, and by reason of being soft and compressible, in operative condition provides a comfortable but secure water seal established about the eye piece.

BRIEF DESCRIPTION OF THE DRAWINGS

These and other objects and advantages are attained by the invention, which is described hereinbelow in conjunction with the accompanying drawings, wherein.

DETAILED DESCRIPTION OF A PREFERRED EMBODIMENT

Figure 1:
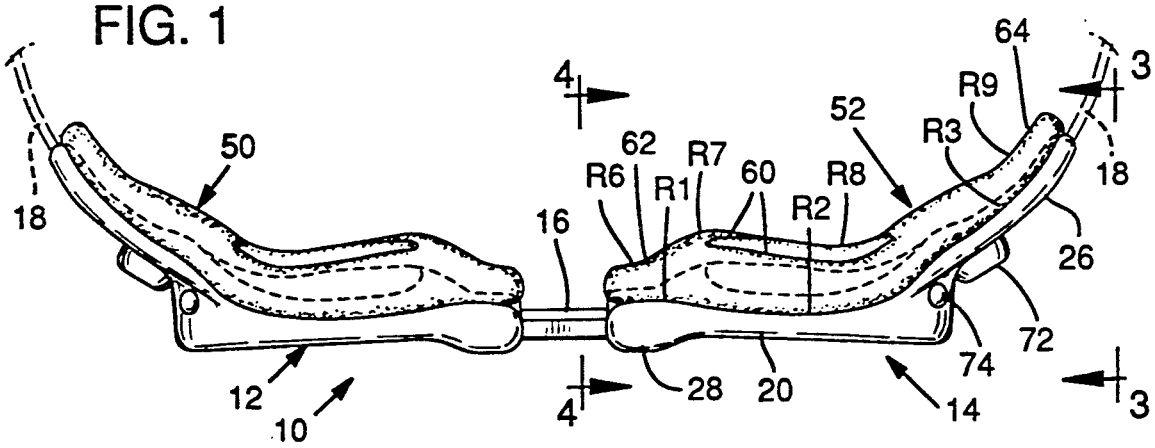
FIG. 1 is a view looking downwardly from the top of a pair of goggles constructed according to the invention.
Figure 2:
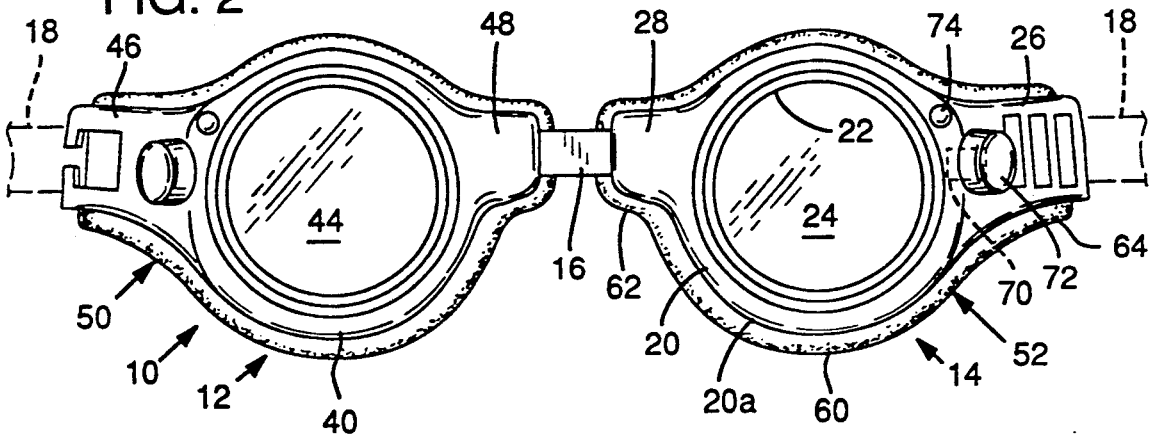
FIG. 2 is a front elevational view of the goggles.
Figure 3:
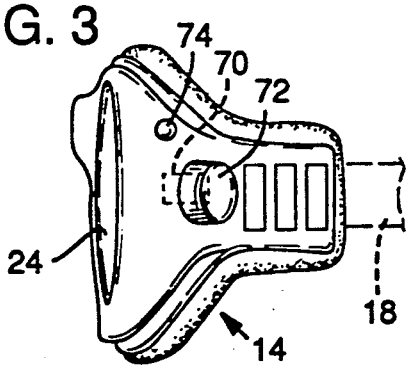
FIG. 3 is an end view of the goggles, as such would appear be viewed along the line 3—3 in FIG. 1.
Figure 4:
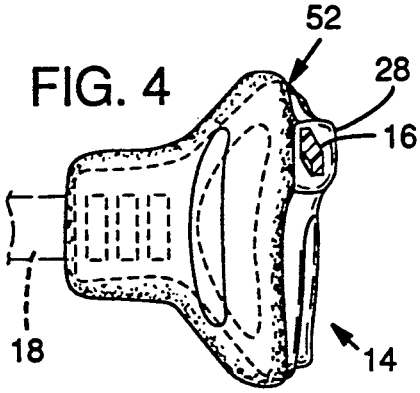
FIG. 4 is a cross-sectional view, taken generally along the line 4—4 in FIG. 1.

Referring now to the drawings, a pair of goggles constructed pursuant to the invention is illustrated generally at 10.

The goggles shown comprise a pair of eye pieces 12, 14. These are connected by a nose piece 16, which may be of flexible material to permit the eye pieces to move independently of each other into a fitted relationship shielding the two eyes of a wearer. Interconnecting laterally outer portions of the two eye pieces is a headband, partially shown at 18.

The two eye pieces are similar in construction. Considering specifically eye piece 14, the eye piece includes a rigid frame portion 20 which may be made of a stiff plastic material. The frame portion extends in a continuous expanse **20*a* about a lens opening 22 circumscribed by the expanse. Closing off this opening and joined to the frame portion is a lens portion 24** which may be made, for instance, of clear plastic.

Also part of the frame portion is what is referred to herein as a temporal wing portion 26, and this wing portion may be an integral part of expanse **20*a***.

With the goggles in use, the eye piece bears against the orbit or socket structure of the eye in the human head. Extension 28 becomes positioned directly alongside the bridge of the nose. Wing portion 26 becomes positioned overlying the temple region of the head. Expanse **20*a*** is spaced in front of the orbit which receives the eye.

To produce optimal fitting of the eye piece to the face, the back of the eye piece, i.e., the side of the eye piece which faces the wearer, is provided with a combination of convex and concave curvatures progressing from adjacent the nose to the temple region of the eye piece. Thus, and as illustrated in FIG. 1, a convex or outwardly curving region is shown at region R1, a concave or inwardly curving region is shown at region R2 and a slightly curving concave region is shown at region R3. While these regions have been separately identified, it should be understood that there is no sharp demarkation between the individual regions, with one smoothly meeting with another progressing from the nose to the temple.

Eye piece 12 is similar to eye piece 14 and includes a continuous expanse 40, an opening bounded by this expanse closed by a lens 44, and wing and extension portions 46, 48 which rest against the temple and adjacent the nose of a wearer, respectively.

To produce a comfortable fit of the goggles against the face, and to establish a proper water-tight seal between each eye piece and the anatomy of the head which encircles the eye of a wearer, each eye piece is provided with an inflatable cushion or cushion member, shown for the respective eye pieces at 50 and 52.

Each cushion member takes the form of a hollow bladder element made of a suitable elastomer, whereby the element is enabled to hold within it a volume of air maintained at proper pressure. The cushion member includes a continuous loop portion, shown at 60, which encircles the lens of the eye piece with which the cushion member is associated, and extension portions 62, 64 which extend alongside the nose extension portion and the wing portion of an eye piece. Portions 62 and 64 of a cushion member all are hollow, and their hollow interiors all join to form a common hollow space to be inflated with air.

Each cushion member has a back surface which faces to the back of the goggles. With the goggles in use, this back surface lies against the face of the wearer. The cushion in its back surface has a preformed shape and this refers to the shape that the surface assumes with enough air in the cushion to cause it to fill out rather than occupy a collapsed state. Specifically, the back surface of the cushion member is preformed to have regions of inward or concave curvature, and outward or convex curvature, progressing laterally or between the nose to and the temporal region of the eye piece. In FIG. 1, a concave curvature is shown at region R6, a convex curvature at region R7, and concave curvatures at regions R8 and R9.

Each cushion member is provided with it own pump and control valve, for establishing and maintaining a pressure of air within it, and forming part of the eye piece with which the cushion member is associated. Specifically, and considering eye piece 14, a pump indicated in outline at 70 is actuated by repeated pressing and release, as with the thumb, of button 72 carried externally of the eye piece. Air ejected by the pump inflates the cushion member 50. A suitable valve, including valve actuator 74, carried exteriorly of the eye piece, is actuated to release air from the cushion member. It should be obvious that to inflate a cushion member and to obtain the desired pressure, button 72 is repeatedly depressed until the pressure condition is reached. To release air and reduce the pressure within the cushion member, actuator 74 is depressed. Usually, enough air is introduced into a cushion member whereby such is inflated at least to establish its preformed shape, as earlier described. Additional air is introduced into a cushion member to produce either a soft or more firmer feeling of the cushion member against the face according to the desires of the wearer.

A headband 18 had been described, earlier. Only portions of this headband have been illustrated, but it should be understood that such extends continuously about the head of a wearer, and by pulling the goggles and the eye pieces in the goggles against the face, the headband functions to produce pressure of the inflated cushion members against the regions of the face which directly encircle the eye.

Goggles constructed as contemplated are very light in weight, and comfortable to wear. A separate lens is provided for each eye of the wearer, and the goggles may be constructed so that these lenses are carried close to the eyes to provide a wide field of view. A streamlined design may be imparted to the goggles, giving them a pleasing appearance and reducing water turbulence when the goggles are worn by a swimmer. A separate seal is provide for each eye piece and its lens, and should there be some leakage associated with one eye piece, this is not carried over to the other. The goggles are very easily mounted in proper position on the head with a comfortable fit established.

While an embodiment of the invention has been described, it should be obvious that variations and modifications are possible without departing from the invention, and it is not desired to limit the invention to the exact details herein discussed.

It is claimed and desired to secure by Letters Patent:

1. In a pair of goggles, a pair of eye pieces, each adapted to fit against the orbit structure of respective eyes of a wearer, each eye piece including a rigid frame portion extending in a continuous expanse about a lens opening, and a transparent lens portion joined about its perimeter to the frame portion closing said lens opening, the frame portion of each eye piece having a back side which faces the wearer.

an inflatable cushion member for each eye piece extending throughout the continuous expanse of the frame portion in a course encircling the lens opening in the eye piece and the cushion member lying against the back side of the frame portion in the eye piece, the cushion member having a preshaped in-curved and out-curved curvature where such curvature contacts the orbit structure and progressing from the nose to the temple of the face of the wearer, and means for establishing and maintaining a pressure of air within the cushion members of the goggles.

2. The goggles of claim 1, wherein the back side of each frame portion has inwardly and outwardly curving regions progressing in a direction extending from the nose to the temple of the face of a wearer.

3. The goggles of claim 1, wherein the means for establishing and maintaining a pressure of air comprises a separate manually actuatable pump for each eye piece mounted on the frame portion of the eye piece and valving for each eye piece carried by the frame portion of the eye piece enabling the release of air.

4. The goggles of claim 1, which further comprises a flexible headband detachably mounted on laterally outer portions of the two eye pieces and adapted to fit about the back of the head of the wearer, the headband when in place pressing said cushion members of the goggles against the face of the wearer.

5. In a pair of goggles, a pair of eye pieces, each eye piece including a rigid frame portion extending in a continuous expanse about a lens opening and a lens portion joined to the frame portion closing said lens opening, an inflatable cushion for each eye piece mounted against the frame portion of the eye piece and the cushion extending in a continuous course throughout said continuous expanse of the frame portion, and means for each eye piece operable independently of the other eye piece for establishing and maintaining a pressure of air within the cushion associated with the eye piece.

6. The goggles of claim 5, wherein the means for establishing and maintaining the pressure of air comprises a separate pump for each eye piece mounted on the frame portion of the eye piece and a separate valve for each eye piece also mounted on the frame portion for the eye piece.

7. The goggles of claim 6, wherein the cushion for each eye piece, where the cushion contacts the face of a wearer, is preshaped to have in-curved and out-curved regions progressing in a direction extending from the nose to the temple of the face of a wearer.

8. The goggles of claim 7, wherein the frame portion for each eye piece has a back side which faces the wearer and the back side has inwardly and outwardly curving regions progressing in a direction extending from the nose to the temple of the face of a wearer.

9. In a pair of goggles, a pair of eye pieces, each eye piece including a rigid frame portion extending in a continuous expanse about a lens opening and a lens portion joined to the frame portion closing said lens opening, the frame portion of each eye piece having a back side which faces a wearer, the back side of the frame portion having inwardly and outwardly curving regions progressing in a direction extending from the nose to the temple of the face of the wearer, an inflatable cushion for each eye piece mounted against the back side of the frame portion of the eye piece, the cushion extending in a continuous course throughout the continuous expanse of the frame portion and following the inwardly and outwardly curving regions of the frame portion, and means for establishing and maintaining a pressure of air within the cushions of the goggles.

* * * * *